United States Patent [19]

Hara et al.

[11] Patent Number: 4,920,903

[45] Date of Patent: May 1, 1990

[54] DEVICE FOR ADJUSTING A LOWER THREAD IN A SEWING MACHINE

[75] Inventors: Kazumasa Hara; Mikio Koike; Mitsuru Nishijima; Koji Okutani, all of Tokyo, Japan

[73] Assignee: Janome Sewing Machine Co. Ltd., Tokyo, Japan

[21] Appl. No.: 277,002

[22] Filed: Nov. 28, 1988

[30] Foreign Application Priority Data

Nov. 27, 1987 [JP] Japan ..... 62-297379

[51] Int. Cl.[5] ..... D05B 3/02; D05B 19/00; D05B 57/26

[52] U.S. Cl. ..... 112/229; 112/184; 112/255; 112/458

[58] Field of Search ..... 112/458, 229, 255, 184

[56] References Cited

U.S. PATENT DOCUMENTS 4,429,649 2/1984 Eguchi et al. ..... 112/229
4,458,613 7/1984 Eguchi et al. ..... 112/229 X
4,542,706 9/1985 Hanyu et al. ..... 112/229
4,693,193 9/1987 Hanyu et al. ..... 112/458 X
4,700,644 10/1987 Eguchi et al. ..... 112/229 X

*Primary Examiner*—Andrew M. Falik
*Attorney, Agent, or Firm*—Michael J. Striker

[57] ABSTRACT

A lower thread tension adjusting device for a sewing machine comprising first and second tension arrangements mounted on a bobbin carrier of the sewing machine for tensioning a lower thread with a predetermined tension and a predetermined additional tension, respectively. A positioning device is mounted on the bobbin carrier and movable between first and second set positions in which the positioning devices moves the second tension arrangement to operative and inoperative positions wherein the second arrangement provides and does not provide the predetermined additional tension of the lower thread. A guide assembly guides the lower thread to positions adjacent to one end and a center of a laterally elongated needle hole and simultaneously guides the positioning device to the first and second positions thereof. A control unit moves the guide assembly between first and second guide positions thereof in accordance with selected patterns of straight and zigzag stitches, respectively.

4 Claims, 9 Drawing Sheets

A
B
C
D
18a
34
40
41
42
60
41a
36a
36
38
35
35a
35b
44a
37
33
32a
39
32
43a
44
32b
1
48
49
50
28
43
46
47
43c
43b
45
41b
48b
44a
43a
48a
a
51
52
52a
53
53a
53b
53c
53d
54
54a
52b
55

A
B
C
D
1
18a
32b
32
32a
33
34
35
35a
35b
36
36a
37
38
39
40
41
41a
43
43a
43b
43c
44
44a
45
46
47
48
48a
48c
49
50
51
52
52a
52b
53
53a
53d
55
60
28
b

4 : Pattern selecting means
56 : Memory of pattern forming information
57 : Discriminating means for pattern sorts
59 : Central processing unit
14 : Stepping motor for needle bar amplitude
25 : Stepping motor for feed adjustment
54 : Stepping motor for adjusting lower thread
58 : Memory of selected patterns 6
17
40
28

6
17
40
28

DEVICE FOR ADJUSTING A LOWER THREAD IN A SEWING MACHINE

FIELD OF THE INVENTION

The invention relates to a sewing machine and more particularly relates to a device for adjusting tension of a lower thread and, also, for changing a lower thread path from a thread source to a fabric to be sewn in dependence upon selection of a pattern of straight stitches or of a pattern of zigzag stitches, to thereby selectively provide a most appropriate stitching condition for the pattern of straight stitches and for the pattern of zigzag stitches.

BACKGROUND OF THE INVENTION

Generally a sewing machine is designed to produce stitches with an upper thread (needle thread) and a lower thread which are locked with each other to form generally so called lock stitches. Especially in case of the straight stitches, if the upper and lower threads are normally locked as shown in FIG. 10, the normal lock stitches are formed as desired. On the other hand, if the upper and lower threads happen to be irregularly locked as shown in FIG. 11, the irregular lock stitches, which are generally called hitch stitches, are formed. If the hitch stitches are mixed in a series of the normal lock stitches, the stitches will lack uniformity and will have a lower quality of stitches as shown in FIG. 14.

Further the normal lock stitches are the products of the upper and lower threads locked with each other in accordance with the twist of the threads. On the other hand, the hitch stitches are the products of the upper and lower threads locked with each other in a manner as to untwist the thread, especially the upper thread.

The formation of normal stitches or hitch stitches depends on a position of a lower thread with respect to a needle which drops to one point at all times. As shown in FIG. 12, if the lower thread 40 is positioned on the left side of the needle from a view of a machine operator, the loop taker is rotated counter-clockwise as shown by an arrow, and catches a needle thread loop formed on the right side of the lower thread and locks the needle (upper) thread to the lower thread through a stitch formation phases, FIG. 12(*a*)–(*g*). As the result, the normal stitch is formed. On the other hand, if the lower thread is positioned on the right side of the needle as shown in FIG. 13, the loop taker is rotated to catch a needle thread loop formed on the left side of the lower thread and locks the needle thread to the lower thread through a stitch formation phases, FIG. 13(*a*)–(*g*). As the result, the hitch stitch is formed.

It is therefore required to provide the condition in FIG. 12 to secure the formation of the normal stitches at all times. This requirement may be satisfied by supplying the lower thread in a manner that the lower thread is drawn out from the bobbin carrier at a cut-out as shown in FIGS. 1 and 3, which is located leftward of the left end of a laterally elongated needle dropping hole of a needle plate.

As particularly shown in FIG. 15(*a*), the lower thread is supplied to the left end L of the laterally elongated needle dropping hole from a position opposite to the needle hole and leftward of the left L of the needle hole, because the straight stitches are generally formed with a needle position set adjacent to the left end L of the laterally elongated needle hole 18*a* within which the needle is laterally swingable from minimum to maximum for zigzag stitches. The needle position adjacent to the left and L of the needle hole is so set as to reduce the up and down movements of a fabric which may otherwise be caused as the needle penetrates into and out of the fabric to be sewn.

However with references to FIG. 15(*a*), in case of zigzag stitching, the needle is swingable between the opposite needle positions L and R over a distance D. It is therefore observed that the required amount of lower thread is different depending upon the needle positions L and R. Much more amount of lower thread is required when the needle come to the right end needle position R. The thread tension due to drawing out an additional amount of lower thread will pull the needle thread down onto the underside of the fabric to be sewn in contrast to the right-side lock of threads as shown in FIG. 16. Namely the tread locking positions are unblanced.

In order to form the zigzag stitches of balanced thread locking positions as shown in FIG. 17, it is required to provide a condition for supplying the same amount of lower thread to both needle positions L and R from the lower source, that is, a condition as shown in FIG. 15(*b*), providing the thread paths of a same distance from a thread supply to the needle positions L and R, respectively.

Japanese utility model laid-open application 56-23074 discloses a sewing machine having a lower thread normally drawn out from a thread source through an opening located at a position corresponding to a center of a laterally elongated needle dropping hole of a needle plate, wherein a thread guide member is operatively connected to a pattern selecting device including a plurality of pattern selecting keys, and is operated in response to selection of a straight stitch pattern to guide the lower thread toward a left side with respect to the left end of the laterally elongated needle dropping hole from a view of a machine operator.

The prior art is actually successful in preventing the formation of hitch stitches in connection with the straight stitches. However as far as the zigzag stitches are concerned, which require the needle thread to extend laterally of the fabric feeding direction, the fabric is easily shrunk in the lateral direction due to the zigzag stitches if the lower thread tension is kept the same as in the case of the straight stitches. It is therefore required to separately adjust the upper thread tension to prevent such shrinkage of fabric. It is, however, insufficient to completely prevent such shrinking phenomena of fabric only by separately adjusting the upper thread tension.

SUMMARY OF THE INVENTION

The object of the invention is to eliminate the defects and disadvantages of the prior art. It is, therefore, a primary object of the invention to provide a device to be operated in response to selection of a pattern of straight stitches to adjust a tension of a lower thread to a first set value and, simultaneously, set a first lower thread path from a thread source to a fabric to be sewn, the device being operated in response to selection of a pattern of zigzag stitches to adjust the tension of the lower thread to a second set value and simultaneously set a second lower thread path from the thread source to the fabric.

It is another object of the invention to provide a device which is compact in structure and easy in operation to give most appropriate stitching conditions each specific to the straight stitches and to the zigzag stitches.

In short, the present invention relates to a sewing machine having a needle plate having a laterally elongated needle hole formed therein, stitch forming means including a needle vertically reciprocable through the needle hole and laterally swingable within the laterally elongated range of the needle hole, and a loop taker having a bobbin carrier positioned therein, the bobbin carrier carrying therein a bobbin loaded with a lower thread, the loop taker being rotated to cooperate with the reciprocating needle to form a stitch with the upper and lower thread, and pattern selecting means including pattern selecting keys selectively operated to select different patterns of zigzag stitches including a pattern of straight stitches stored in a memory in the form of pattern data, the lower thread tension adjusting device comprising first tension means mounted on the bobbin carrier for tensioning with a predetermined degree of tension the lower thread; second tension means mounted on the bobbin carrier and movable between an operative position in which the second tension means tensions with a predetermined tension the lower thread in addition to the tension provided by the first tension means, and an inoperative position in which the second tension means does not tension the lower thread; positioning means mounted on the bobbin carrier and movable between a first set position in which the positioning means moves the second tension means to the operative position, and a second set position in which the positioning means moves the second tension means to the inoperative position; guide means movable between a first guide position in which the guide means guides the lower thread to a position adjacent to one end of the laterally elongated needle hole and simultaneously guides the positioning means to the first set position, and a second guide position in which the guide means guides the lower thread to a position adjacent to a center of the laterally elongated needle hole and simultaneously guides the positioning means to the second set position; and control means responsive to a selective operation of the pattern selecting keys selecting the pattern of straight stitches to move the guide means to the first guide position, and responsive to selection of some of the patterns of zigzag stitches to move the guide means to the second guide position.

BRIEF DESCRIPTION OF THE DRAWINGS

FIG. 15(*b*) is a diagrammatic view of the elongated needle dropping hole and the lower thread showing a zigzag stitching condition according to the invention;

FIG. 18 is an exploded view of elements of a lower thread tension adjusting device shown in FIGS. 1 and 2.

DETAILED DESCRIPTION OF PREFERRED EMBODIMENTS OF THE INVENTION

Embodiments of the invention will be explained in detail with reference to the attached drawings.

Figure 5:
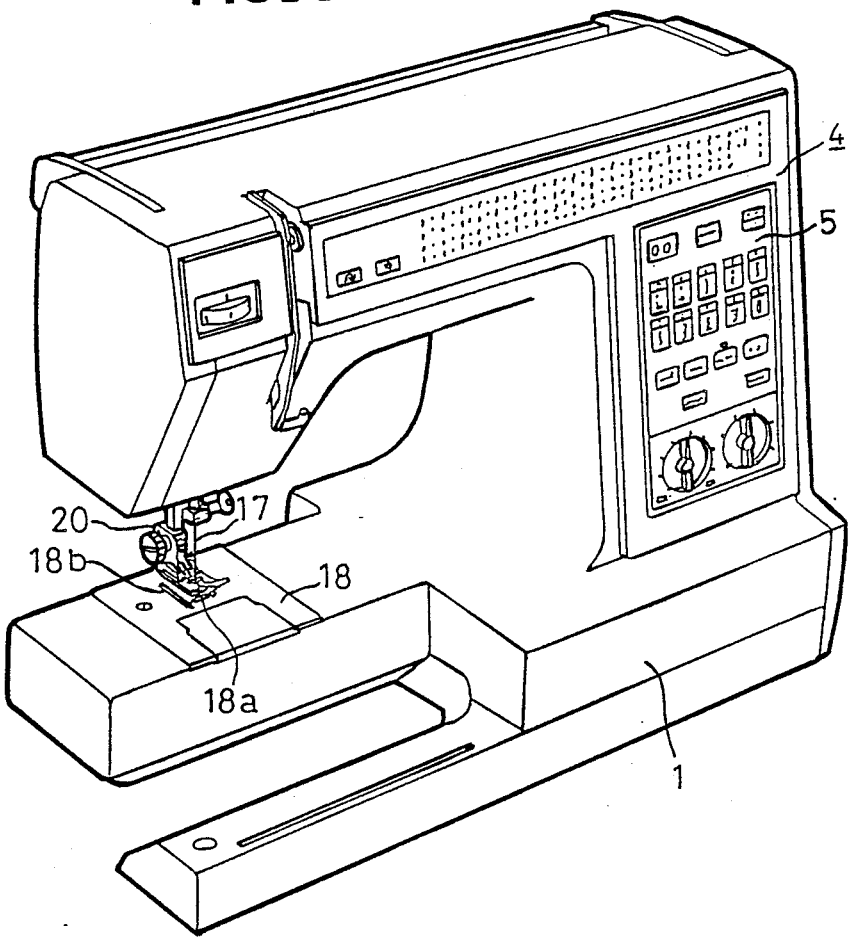
FIG. 5 is a perspective view of a sewing machine having the lower thread tension adjusting device of the invention incorporated therein.

With reference to FIG. 5, a sewing machine has a machine frame 1 having a key board 5 as a pattern selecting means for selecting a plurality of different patterns stored in a memeory.

Figure 6:
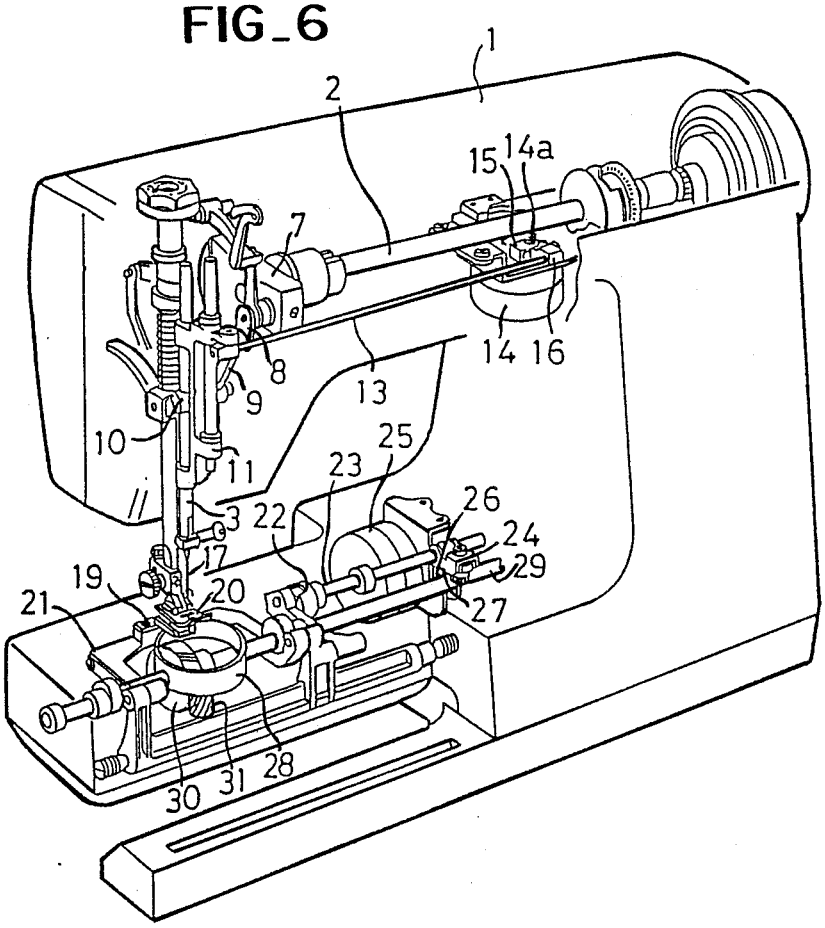
FIG. 6 is a perspective view of a sewing machine showing a basic mechanism thereof with the adjusting device of the invention applied thereto.

With reference to FIG. 6, a needle bar 3 is mounted on the machine frame 1 and is vertically movably in connection with an upper shaft 2 which is rotatably mounted (journalled) on the machine frame. Namely as generally known, the needle bar 3 is slidable by a needle bar support 11 and is fixedly connected to a needle holder 10 which is connected to a needle bar crank 8 by a crank rod 9. The crank 8 is operatively connected to a balance weight 7 secured to one end of the upper shaft 2 for rotation therewith. The needle bar supporter 11 is swingable mounted on a vertical shaft 12 secured to the machine frame 1, and is prevented from vertical movement. The needle bar support 11 is connected to one end of a rod 13 which has the other end connected to an arm 15 secured on an output shaft 14*a* of a stepping motor 14 for controlling the needle position.

A feed dog 19 is mounted on a horizontal feed arm 21 to be driven by the drive shaft 1. The movement of the horizontal feed arm 21 is adjusted by adjusting the angular position of a member 22 fixed to one end of an adjusting shaft 23 which has the other end secured to an arm 24 connected to a crank 26 mounted on the output shaft of a feed control stepping motor 25 by way of the crank 26 and a link 27.

A loop taker 28 serving as the needle thread catching means, is rotatably supported on the machine frame 1 under the needle plate 18, and a gear 30 is in mesh with a gear 31, the former being secured on a lower shaft 2 to be rotated in synchronism with the needle bar 3 by the upper shaft 29, and the latter being secured to a rotation axle of the loop taker 28.

The construction and operation of the lower thread adjusting device will be explained below.

Figures 1, 2:
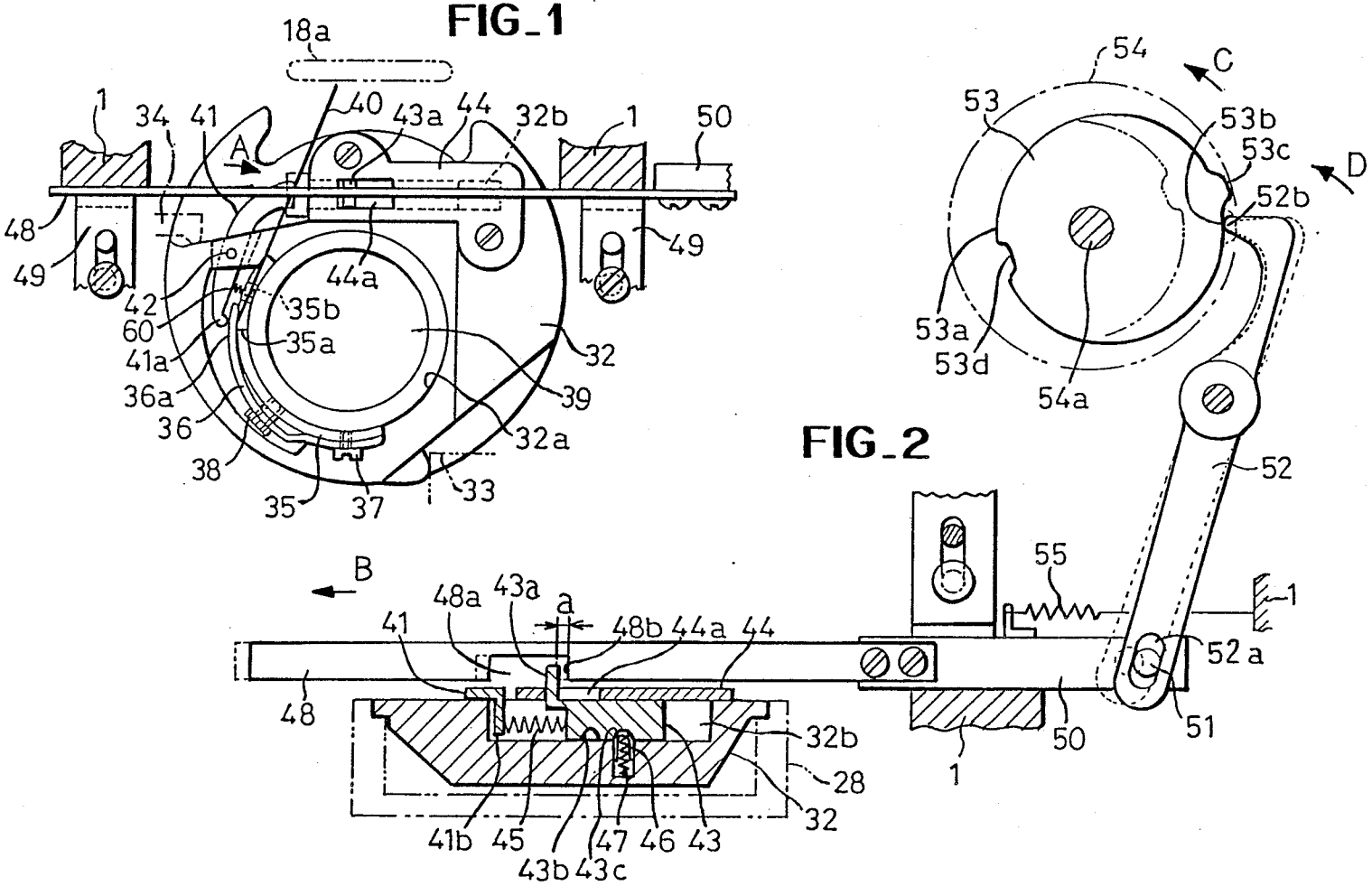
FIG. 1 is a plan view of a essential part of a lower thread tension adjusting device according to the invention shown in one operational phase.
FIG. 2 is a front elevational view of the tension adjusting device of the invention shown partly in vertical section in connection with FIG. 1.

FIGS. 1 and 2 show that a bobbin carrier 32 is rotatably support within a loop taker 28. The bobbin carrier 32 contacts rotation checkers 33 and 34 secured to the machine frame 1, and is restrained from rotation. A base plate 35 having a lower thread D draw-out opening 35*a*, is fixed on an outer circumference of a bobbin housing 32*a* provided in the bobbin carrier 32. A lower thread tension spring 36 comprises a thin sheet and is secured to the frame 35 at its one end by a screw 37. An end 36*a* of the tension spring 36 is positioned on a slit of the opening 35*a*, and the spring 36 is formed with a hole at its center for inserting a headed screw 38.

The headed screw 38 passes through the hole of the spring 36 and is screwed into a threaded hole of the base plate 35, and the headed screw 38 presses the spring 36 with its head so as to adjust a pressure exerted between the end 35*a* of the tension spring 36 and the lower thread drawing opening 35*a*.

A bobbin 39 with the lower thread 40 is rotatably fitted in the bobbin housing 32*a* of the bobbin carrier 32. The lower thread 40 is drawn from the opening 35*a* through a thread guiding slit formed in the base plate 35, and is effected with tension by the pressure of the lower thread spring 36, so that it is drawn toward the fabric from laterally elongated needle hole 18*a* of the needle plate 18 (see FIG. 5).

A level 41 is rotatable at its center around by a pin 42 fixed to the bobbin carrier 32, and is formed with a presser 41*a* at its one end to be pressed against a free end of the spring 36 (FIG. 1) and has an opposite end 41*b* bent down into an elongated recess 32*b* formed in the bobbin carrier 32 and extending in parallel with the needle hole.

A small spring 60 has one end held in a hole 35*b* formed in the base plate 35, and has an opposite end pressed against the lever 41 so that the lever 41 is normally turned in a direction shown by arrow A.

A slider 43 has a width for smoothly moving in length of the oblong groove 32*b* of the bobbin carrier 32. The slider 43 has a standing part 43*a* at its end, and a guide member 44 has a groove 44*a* for moving the standing part 43*a* in the length of the groove 32*b*, is fixed to the bobbin carrier 32. A pressing spring 45 is positioned between the end 41*b* of the lever 41 and the slider 48.

A stopper 46 slidably implanted within the bobbin carrier 32, and is normally biased in an upper direction by a spring 47. The stopper 46 has a semicircular head for selectively engaging holes 43*b* and 43*c* formed on the lower side of the silder 43. An actuating lever 48 is supported by the machine frame 1 above the elongated hole 32*b* and is pressed against the frame 1 by a presser pieces 49 and is slidable in a direction of an arrow B and in the opposite direction thereof above the length of the elongated hole 32. The lever 48 has a cut-out 48*a* formed on a lower side thereof for engaging the standing part 43*a* of the silder 43. The actuating lever 48 is fixed at its one end with an end of an actuating body 50 supported by the machine frame 1 sildably along the length of the elongated hole 32*b*. The lever 48 has a pin 51 at its other end, which passes movably through a hole 52*a* formed in one end of an actuating pawl 52.

A cam 53 is secured on an output shaft 54*a* of a stepping motor 54 fixed to the machine frame 1 for adjusting the lower thread, and is defined with an operative part 53*a* and an inoperative part 53*b* on its outer circumference. The inoperative part 53*b* is formed in a large diameter part of the cam 53 with respect to the output shaft 54*a*. The cam 54 has a projected part 53*c* formed just on a side of a rotating direction C of the stepping motor 54 from the largest diameter part 53*b* as shown in FIG. 2. The operative part 53*a* is formed in a small diameter part with respect to the center of the output shaft 54*a*.

The actuating pawl 52 has a pawl portion 52*b* at its one end, and is connected with the actuating body 50. A spring 55 is connected at its one end with the actuating body 50 and is connected at its other end with the machine frame 1, so that the actuating pawl 52 is rotated in an direction of an arrow D via the pin 51, and the pawl portion 52*b* contacts the cam 53.

Figure 7:
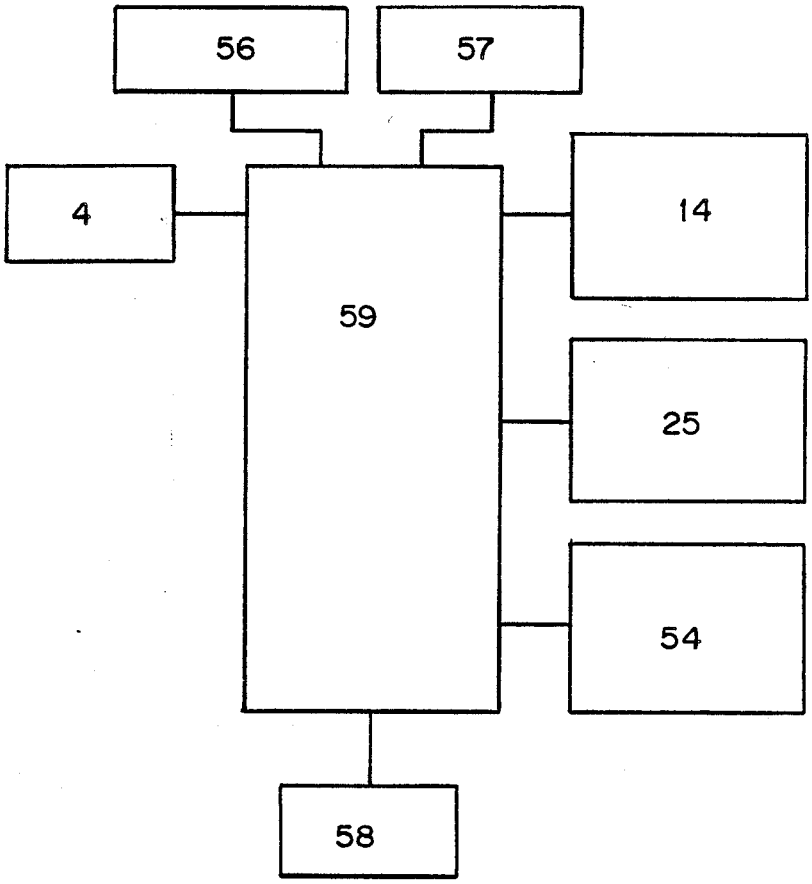
FIG. 7 is a block diagram showing a control system of the lower thread tension adjusting device of the invention.

FIG. 7 is a control block diagram where a reference numeral 4 is a pattern selecting means, 56 is a memory storing pattern forming information, 57 is means for discriminating a type of selected pattern, and 58 is a memory for storing a selected pattern. These means are connected to a central processing unit 59.

An explanation will be made of actuation of the lower thread tension adjusting device constructed as stated above.

A key board 5 of the pattern selecting means 4 is operated to select a desired pattern. Pattern forming information and pattern code corresponding to the selected pattern are read out from the pattern forming information memory 56, and stored in the selected pattern memory 58. THe discriminating means 57 discriminates if the selected pattern is a straight stitching or a pattern of zigzag stitches, and the straight stitching is assigned with "1", and other patterns of zigzag stitches are assigned with "0".

A reference will be made to a case that a selected pattern is a straight stitching.

Since the pattern code is "1", the discriminating means 57 outputs to the central processing unit 59 a signal of "the pattern is a straight stitching, and the lower thread adjusting means should be set to the straight stitching condition."

Then, the CPU 59 is operated to rotate the stepping motor 54 in the direction of the arrow C until the projection 53*c* of the cam 53 is rotated past the pawl portion 52*b* of the actuating pawl 52 as shown in FIG. 2. The inoperative part 53*b* is at the maximum biasing position with respect to the output shaft 54*a* of the stepping motor 54, and since the projection 53*c* is at a more remote position then the maximum biasing position, the pawl 52 is once rotated in the direction opposite to the direction of the arrow D, and the actuating body 50 and the actuating lever 48 are moved in the arrow B aginst the action of the spring 55 via the pin 51 engaging in the hole 52*a*.

By the movement of the actuating level 48, the right side 48*b* of the cut-out 48*a* therefore engages the standing part 43*a* of the slider 43 and moves the slider 43 in the same direction until the silder 43 presses down the stopper 46 against the pressure of the spring 47, and the hole 43*c* is engaged by the stopper 46 at the position shown in FIG. 2. The stepping motor 54 is further rotated in the arrow C and stops at a position where the pawl portion 52*b* of the actuating pawl 52 comes down the projection 53*c* and contacts the inoperative part 53*b* of the actuating cam 53. Since the inoperative part 53*b* is set lower than the projection 53*c*, the actuating pawl 52 rotates a bit in the direction of the arrow D and stops at the position shown with the solid line of the same.

Therefore, the actuating lever 48 moves a bit in the direction opposite to the direction of the arrow B to the position shown with the solid line of FIG. 2, and as the result, a space "a" is formed between the side 48*b* and the standing part 43*a* for passing there through the upper thread to be lifted up after interlocked with the lower thread.

When the slider 43 comes to the position shown with the solid line of the same, it presses the spring 45 against the end 41*b* of the lever 41. Since the pressure of the spring 45 is larger than that of the small spring 60, the lever 41 rotates in the direction apposite to the direction of the arrow A, and a front presser 41 a is pressed against the lower thread tension spring 36 so as to increase the pressure against the lower thread 40 held between the tension spring 36 and the base plate 35.

Further with the actuating lever 48 at the set position as shown in FIGS. 2, the left side 48*c* of the cutout 48*a* is designed to allow the lower thread 40 to extend from the lower thread draw-out position 35*a* set at the left side, more than the left end L of the needle amplitude range, to the needle position adjacent to the left end L of the laterally elongated needle hole 18*a* as shown in FIG. 1, and the formation of hitch stitches is prevented.

Next explanation will be made to a case when the key board 4 of the pattern selecting means 4 is operated to select stitching patterns other than the straight stitching, that is a pattern of zigzag stitches.

The pattern-forming information and the pattern code are read out from the pattern-forming information memory 56, and stored in the selected pattern memory 58.

Since the pattern code is "0", the pattern discriminating means 57 outputs to the central processing unit 59 a signal of "a pattern of zigzag stitches and the lower thread adjusting means is set to the pattern stitching condition."

Figures 3, 4:
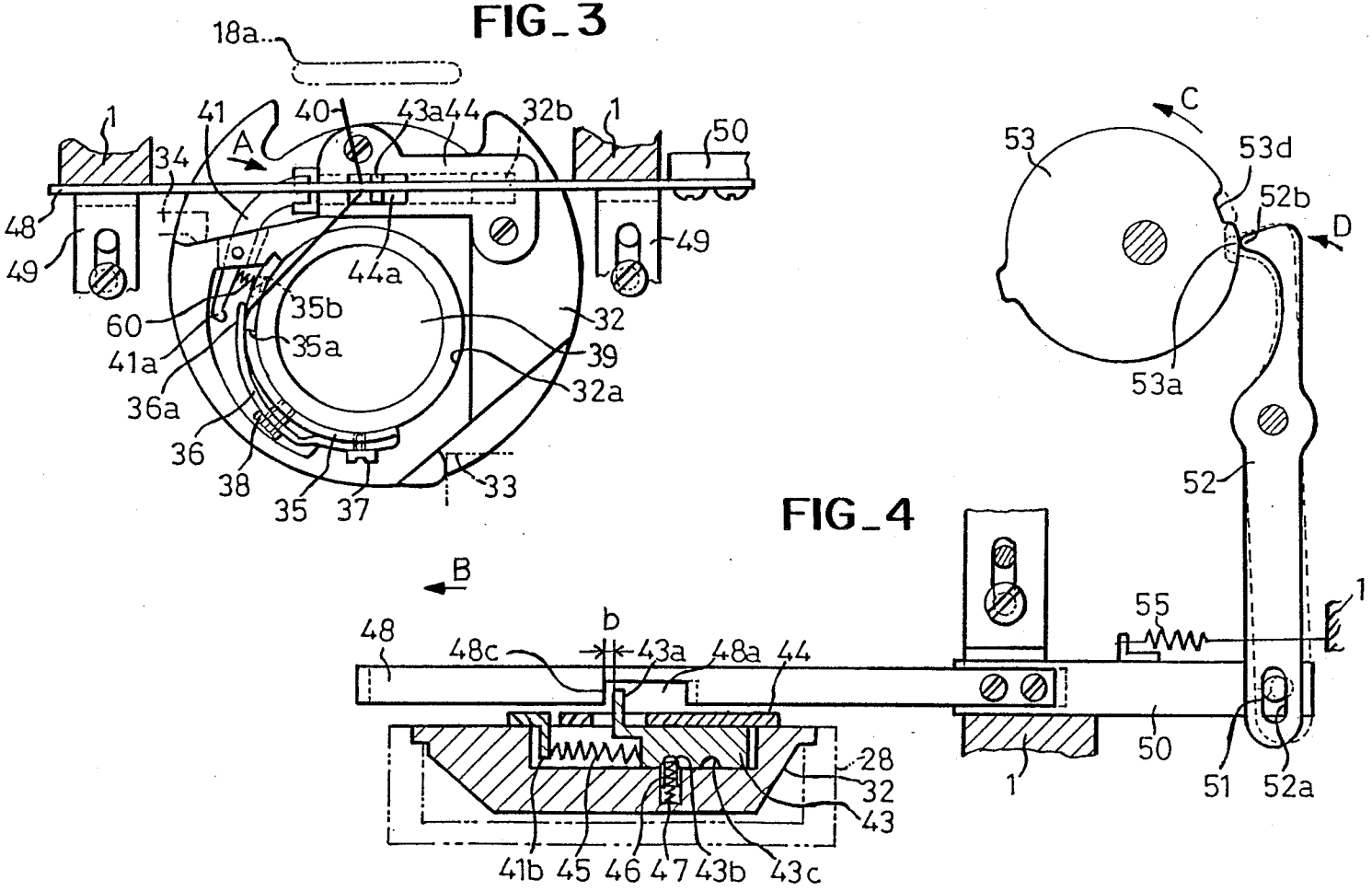
FIG. 3 is a plan of the essential part of the lower thread tension adjusting device shown in another operational phase.
FIG. 4 is a front elevational view of the tension adjusting device of the invention shown partly in vertical section in connection with FIG. 3.

Then the CPU 59 is operated to rotate the stepping motor 54 for adjusting the lower thread, and it is rotated in the direction of the arrow C until a concave 53*d* of the cam 53 engages the pawl portion 52*b* of the actuating pawl 52 as shown with a dotted line in FIG. 4. The operative part 53*a* is at the minimum biasing position with respect to the output shaft 54*a* of the stepping motor 54, and since the concave 53*d* is at a lower position than the maximum biasing position, the pawl 52 is rotated in the direction of the arrow D, and the actuating body 50 and the actuating lever 48 are moved in the direction opposite to the direction of the arrow B by the action of the spring 55 via the pin 51 engaging in the hole 52*a*.

By the movement of the actuating lever 48, the left side 48*c* of the cutout 48*a* thereof engages the standing part 43*a* of the slider 43 and moves the slider 43 in the same direction until the slider 43 presses down the stopper 46 against the pressure of the spring 47 and the hole 43*b* is engaged by the stopper 46 at the position shown in FIG. 4. The stepping motor 54 is further rotated in teh direction of the arrow C until the concave 53*d* disengages from the pawl portion 52*b* of the actuating pawl 52 and the operative part 53*a* of the cam engages the pawl position 52*b*. Since the inopertive part 53*a* is set higher than the concave 53*d*, the actuating pawl 52 rotates a bit in the direction opposite to the direction of the arrow D and stops at the position shown with the solid line of the same.

Thereby, the actuating level 48 moves slightly in the direction of the arrow B to the position shown with the solid line and therefore a space "b" is formed between the side 48*c* and the standing part 43*a* for passing the upper thread tq be lifted up after the thread is interconnected with the lower thread.

When the slider 43 comes to the position shown with the solid line of the same, it decreases the pressure of the spring 45 against the end 41*b* of the lever 41 so that the pressure of the spring 45 is smaller than that of the small spring 60, the lever 41 is therefore rotated in the direction of the arrow A, and the presser 43*a* releases the pressure to the lower thread tension spring 36 so as to decrease the pressure against the lower thread held between the tension spring 36 and the base plate 35.

Figure 15A:
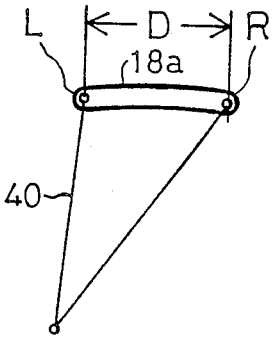
FIG. 15(*a*) is a diagrammatic view of an elongated needle dropping hole and a lower thread showing a zigzag stitching condition of the prior art.
Figure 15B:
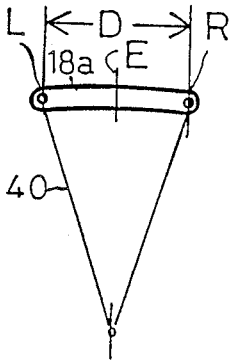
Figure 16:
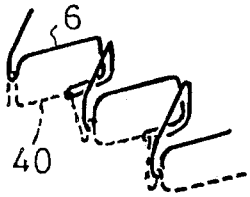
FIG. 16 is a perspective view of zigzag stitches formed under the condition of FIG. 15(*a*)
Figure 17:
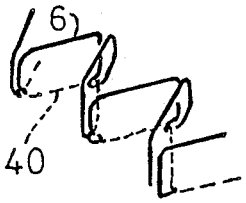
FIG. 17 is a perspective view of zigzag stitches formed under the condition of FIG. 15(*b* )
Figures 12A, 12B, 12C, 12D, 12E, 12F, 12G:
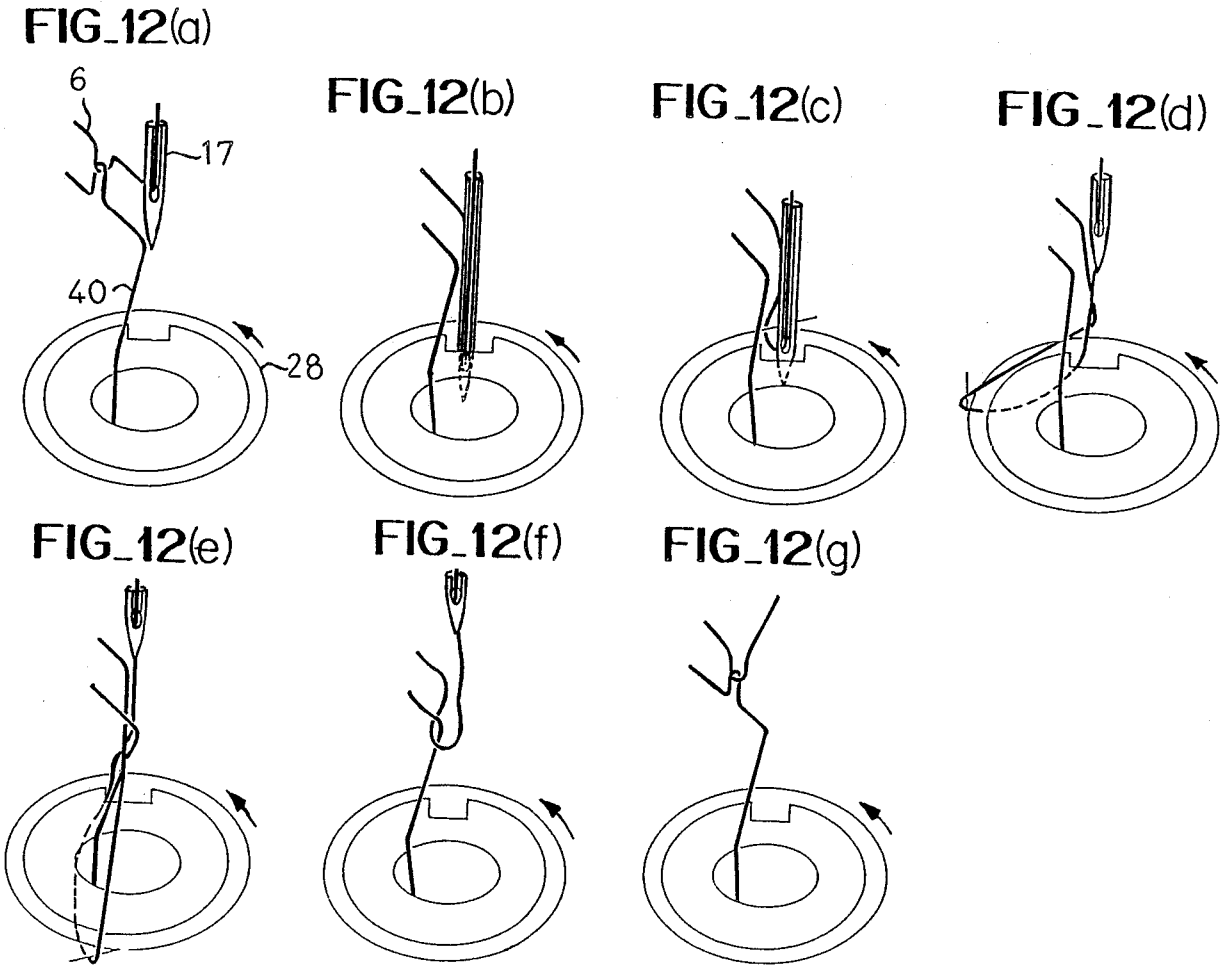
FIGS. 12(*a*)–12(*g*) are diagrammatic views of a needle and a loop taker showing a series of formation processes of the perfect stitch.
Figures 13A, 13B, 13C, 13D, 13E, 13F, 13G:
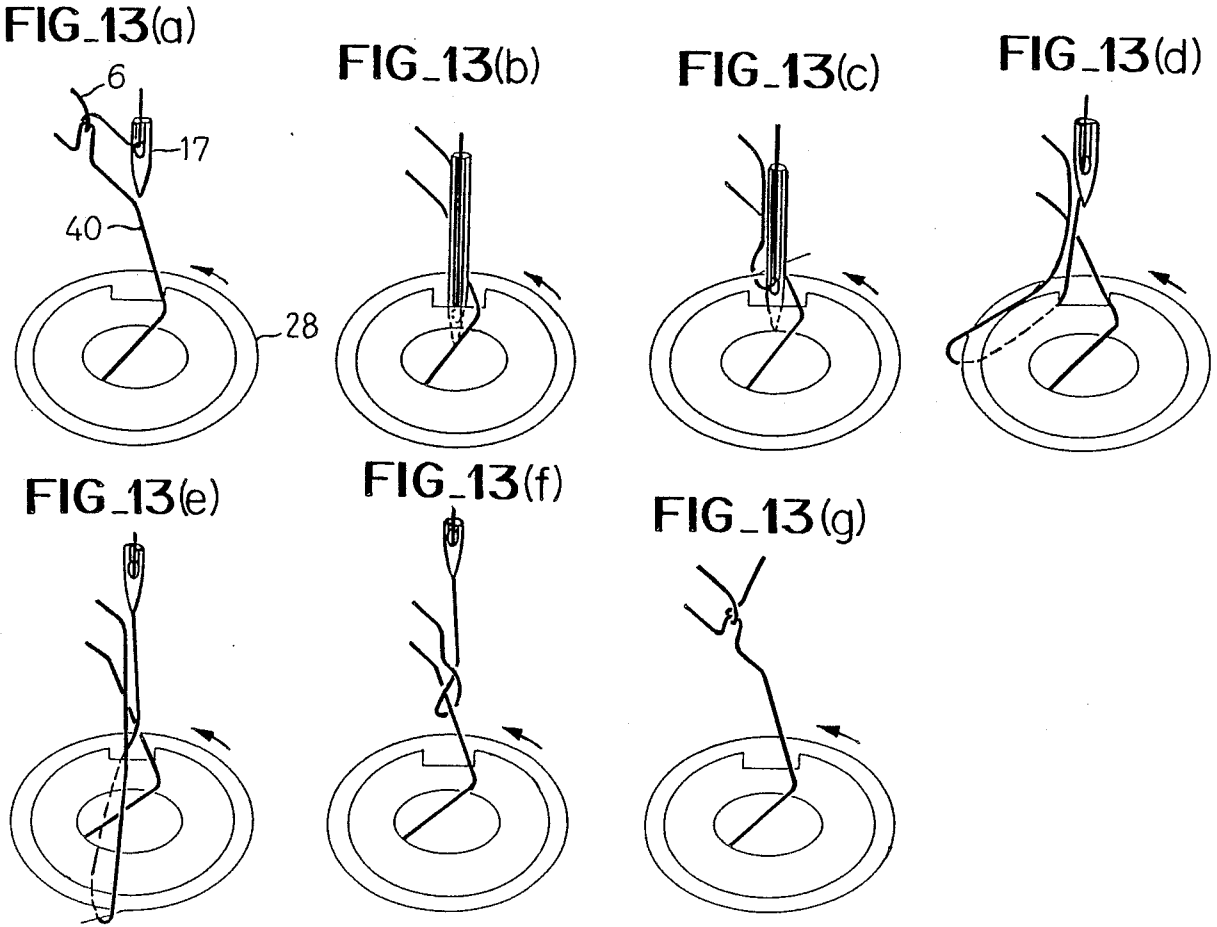
FIGS. 13(*a*)–13(*g*) are diagrammatic views of the needle and the loop taker showing a series of formation steps of the hitch stitch.

Further with the actuating level 48 at the set position as shown in FIG. 4, the left side 48*c* of the cutout 48*a* comes to a position for guiding the lower thread 40 to the center of the laterally elongated needle hole 18*a* to provide the condition as shown in FIG. 15(*b*) which prevents the formation of the unbalanced thread locking phenomena of zigzag stitches as shown in FIG. 16.

Figure 8:
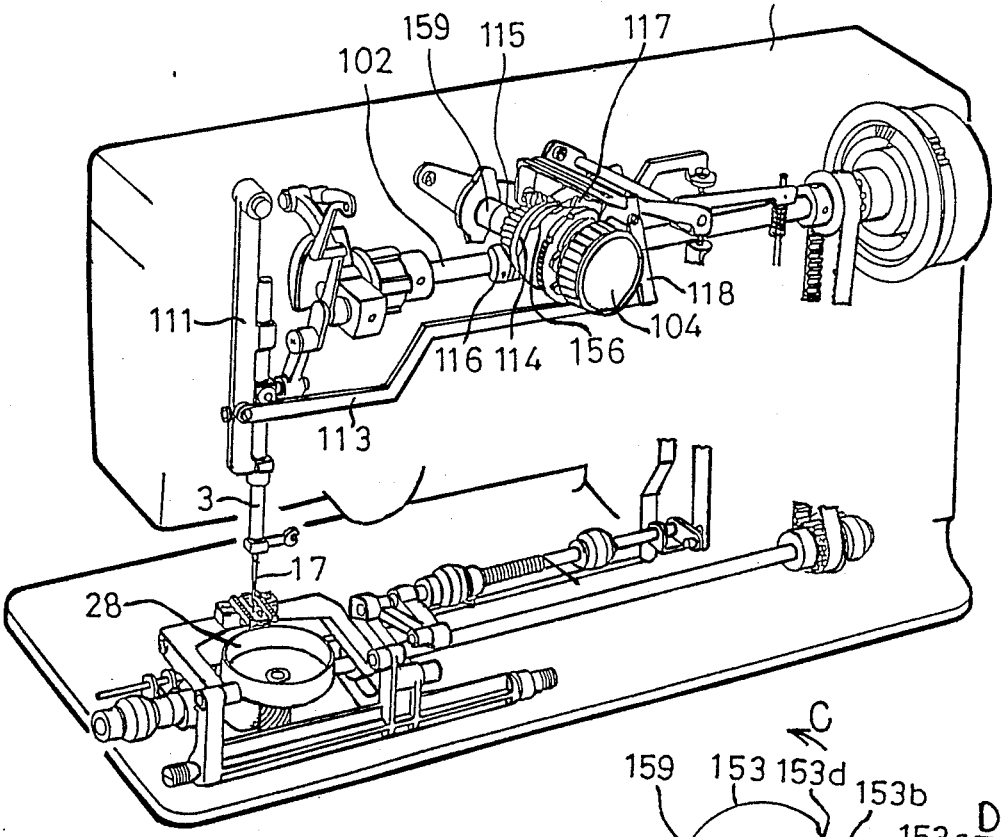
FIG. 8 is a perspective view of a sewing machine showing a second embodiment of the lower thread tension adjusting device of the invention.
Figure 8:
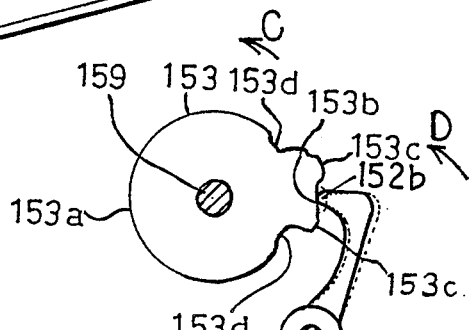
Figure 9:
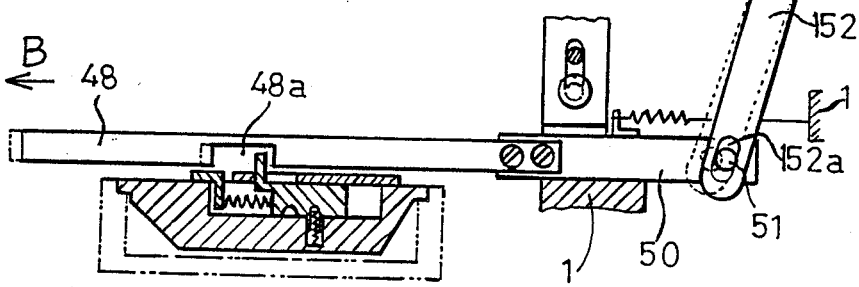
FIG. 9 is a front elevational view of the second embodiment of the lower thread tension adjusting device of the invention shown partly in vertical section.
Figure 10:
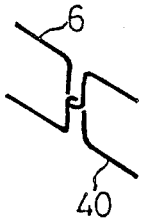
FIG. 10 is a perspective view of a perfect stitch.
Figure 11:
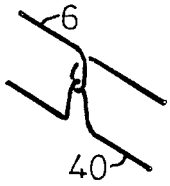
FIG. 11 is a perspective view of a hitch stitch.
Figure 14:
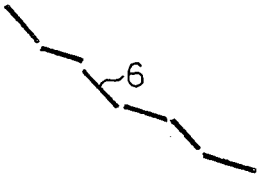
FIG. 14 is a diagrammatic view of the stitches mixed with the perfect and hitch stitches.

The other embodiment will be explained, where the present device is applied to a mechanic sewing machine as shown in FIGS. 8 and 9.

In FIG. 8, a pattern selecting dial 104 is provided on a dial shaft 159 rotatably pivoted on a machine frame 101. A plurality of pattern cams 114 for controlling the needle positions are fixedly mounted on a cam shaft (no shown) rotatably supported to the machine frame 101 together with feed adjusting cams (not shown).

A gear 115 is mounted on the cam shaft 159 and is in mesh with a worm 116 secured to an upper shaft 102 pivoted rotatably to the machine frame.

The pattern cams 114 are selectively engaged by a pawl 117 which is connected to one end of a rod 113 via a transmission means 118, and the rod 113 is connected at its other end with a needle bar supporter 111.

The dial shaft 159 has a lower thread tension adjusting cam 153 and a guide cam 156 mounted thereon for rotation therewith. The cam 156 guides the pawl 117 to select one of the pattern cams 114.

The lower thread adjusting cam 153 is, as seen in FIG. 9, formed with an inoperative part 153*b* which has a large diameter, and two projections 153*c* on the larger diameter part 153*b*. The other part of the outer circumference has a small diameter and is formed with an actuating part 153*a*. Concaves 153*d*, 153*d* are formed on both sides of the projection 153*c*, which are lower than the small diameter part 153*a*. The lower thread adjusting cam 153 is engaged with a pawl part 152*b* of the actuating 152.

The remaining structure of the lower thread adjusting means is the same as in the first embodiment, and the explanation will be omitted.

When the straight stitching is selected by the dial 104, the pawl part 152*b* of the actuating pawl 152 contacts one of the projections 153*c* of the lower thread adjusting cam 153 and the inoperative past one after another. When a pattern of zigzag stitches other than the straight stitching is selected, the pawl part 152*b*, of the actuating pawl 152 engages one of the concaves 153*d* and the actuating part 153*a* of the cam 153 one after another. Therefore, when the pattern selecting dial 104 is rotated clockwise or counterclockwise to rotate the cam 153 to select the straight stitching, the pawl 152 is largely rotated in the direction opposite to the direction of the arrow D by one of the projections 153*c* of the cam 153 to the position shown with the dotted line in FIG. 9. With further rotation of the cam 153, the pawl part 152*b* of the pawl 152 contacts the inoperative part 153*b* and rotates a bit in the direction of the arrow D to the position shown with the solid line of the same.

This position is the same as when the straight stitching is selected in the first embodiment as shown in FIG. 2.

The pattern selecting dial 104 is rotated clockwise or counterclockwise to select a pattern of zigzag stitches other than the straight stitching, the pawl part 152*b* of the pawl 152 contacts one of the concaves 153*d* of the cam 153 and is rotated in the direction of the arrow D to the position such as shown with the dotted line of FIG. 4. With further rotation of the cam 153, the pawl part 152*b* contacts the actuating part 153*a* and is rotated in the direction opposite to the arrow D and is set at the position such as shown with the solid line in FIG. 4.

This position is the same as when a pattern of zigzag stitches other than the straight stitching is selected in the first embodiment as shown in FIG. 4.

Namely in this embodiement, the tension adjusting cam 153 is used in a mechanical sewing machine having a plurality of pattern cams selected by manual rotation of the dial 104, and therefore, the cam 153 is designed to have the configuration as shown in FIG. 9, which is different from the tension adjusting can 53 in FIGS. 2 and 4 used in an electronic sewing machine having a memory storing pattern data for a plurality of different patterns including the straight stitches.

What is claimed is:

1. A lower thread tension adjusting device for a sewing machine having a needle plate having a laterally elongated needle hole formed therein, stitching forming means including a needle vertically reciprocating through the needle hole and laterally swingable within a laterally elongated range of the needle hole, and a loop taker having a bobbin carrier positioned therein, the bobbin carrier carrying therein a bobbin loaded with a lower thread, the loop taker being rotatable to cooperate with the reciprocating needle to form a stitch with upper and lower threads, and pattern selecting means including pattern selecting keys selectively operated to select different patterns of zigzag stitches including a pattern of straight stitches stored in a memory in a form of pattern data, said lower thread tension adjusting device comprising first tension means mounted on the bobbin carrier for tensioning the lower thread with a predetermined tension; second tension means mounted on the bobbin carrier and movable between an operative position in which said second tension means tensions the lower thread with a predetermined tension in addition to tension provided by said first tension means, and an inoperative position in which said second tension means does not tension the lower thread; positioning means mounted on the bobbin carrier and movable between a first set position in which said positioning means moves said second tension means to the operative position thereof, and a second set position in which said positioning means moves said second tension means to the inoperative position thereof; guide means movable between a first guide position in which said guide means guides the lower thread to a position adjacent to one end of the laterally elongated needle hole and simultaneously guides said positioning means to the first set position, and a second guide position in which said guide means guides the lower thread to a position adjacent to a center of the laterally elongated needle hole and simultaneously guides said positioning means to the second set position; and control means responsive to a selective operation of the pattern selecting keys for selecting the pattern of straight stitches to move said guide means of the first guide position, and responsive to a selection of one of the patterns of zigzag stitches to move said guide means to the second guide position.

2. A lower thread tension adjusting device as defined in claim 1, wherein said control means includes a microcomputer and a stepping motor driven under control of said microcomputer.

3. A lower thread adjusting device as defined in claims 2, wherein said guide means includes a cam rotatable by said stepping motor, a cam follower having one end in engagement with said cam, and a guide bar having one end connected to the other end of said cam between first guide position and said second guide position.

4. A lower thread adjusting device as defined in claim 1, further comprising means for holding said positioning means at any of said first and second set positions as said positioning means is moved therebetween.

* * * * *